US008316823B2

(12) United States Patent
Sato et al.

(10) Patent No.: US 8,316,823 B2
(45) Date of Patent: Nov. 27, 2012

(54) PLASMA JET IGNITION PLUG IGNITION CONTROL

(75) Inventors: Yoshikuni Sato, Nagoya (JP); Daisuke Nakano, Kiyosu (JP); Yuichi Yamada, Aichi (JP); Toru Nakamura, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 308 days.

(21) Appl. No.: 12/452,068

(22) PCT Filed: Jan. 8, 2009

(86) PCT No.: PCT/JP2009/050153

§ 371 (c)(1),
(2), (4) Date: Dec. 14, 2009

(87) PCT Pub. No.: WO2009/088045

PCT Pub. Date: Jul. 16, 2009

(65) Prior Publication Data

US 2010/0132666 A1 Jun. 3, 2010

(30) Foreign Application Priority Data

Jan. 8, 2008 (JP) ..... 2008-001591

(51) Int. Cl.
*F02P 5/00* (2006.01)
*F02P 7/02* (2006.01)

(52) U.S. Cl. ..... 123/406.19; 123/143 B

(58) Field of Classification Search ..... 123/406.19, 123/143 B, 143 C, 143 R, 145 A, 145 R, 123/146.5 R, 169 C, 169 R, 169 EL; 313/118, 313/122, 130, 141–143; 219/267, 270, 533, 219/544

See application file for complete search history.

(56) References Cited

U.S. PATENT DOCUMENTS 4,399,802 A * 8/1983 Oshiage et al. ..... 123/406.24
4,416,226 A * 11/1983 Nishida et al. ..... 123/143 B
4,996,967 A * 3/1991 Rosswurm et al. ..... 123/598
6,374,783 B1 * 4/2002 Toriumi ..... 123/90.11
8,007,641 B2 * 8/2011 Winterhalter et al. ... 204/192.13

(Continued)

FOREIGN PATENT DOCUMENTS

JP 57-99272 6/1982

(Continued)

OTHER PUBLICATIONS

Office Action from State Intellectual Property Office of P.R. China from a corresponding Chinese patent application issued on Oct. 18, 2011. 16 pages—Includes English translation.

(Continued)

*Primary Examiner* — John Kwon
*Assistant Examiner* — Johnny Hoang
(74) *Attorney, Agent, or Firm* — Kusner & Jaffe

(57) ABSTRACT

A control system for controlling the ignition of a plasma-jet spark plug provided in an internal combustion engine senses an operating condition of the internal combustion engine, and determines an ignition mode of the plasma-jet spark plug in accordance with the sensed operating condition. The control system performs an ignition control of breaking down the insulation across a spark discharge gap by applying a first electric power to the plasma-jet spark plug, and producing plasma in the vicinity of the spark discharge gap by applying a second electric power to the spark discharge gap in a state of dielectric breakdown. The control system performs this ignition control according to the ignition mode determined as mentioned above.

12 Claims, 13 Drawing Sheets

U.S. PATENT DOCUMENTS

| | | | | |
|---|---|---|---|---|
| 2002/0185097 | A1* | 12/2002 | Ryan, III | 123/143 B |
| 2004/0168671 | A1 | 9/2004 | Yamaguchi et al. | 123/305 |
| 2006/0243238 | A1* | 11/2006 | Anezaki et al. | 123/143 B |
| 2007/0114901 | A1 | 5/2007 | Nagasawa et al. | 313/141 |
| 2007/0157903 | A1* | 7/2007 | Zurlo | 123/406.3 |
| 2007/0221156 | A1 | 9/2007 | Hagiwara et al. | 123/143 |
| 2007/0221157 | A1 | 9/2007 | Hagiwara et al. | 123/143 |

FOREIGN PATENT DOCUMENTS

| | | |
|---|---|---|
| JP | 57193977 | 12/1982 |
| JP | 06-066236 | 3/1994 |
| JP | 2002-327672 | 11/2002 |
| JP | 2007-170371 | 7/2007 |
| JP | 2007-287666 | 11/2007 |
| WO | WO03/010428 | 2/2003 |

OTHER PUBLICATIONS

Notification of Reasons for Refusal (dated Jul. 13, 2012) issued in connection with corresponding Chinese Patent Application No. 200980101559.0, with English translation.

* cited by examiner

PLASMA JET IGNITION PLUG IGNITION CONTROL

TECHNICAL FIELD

The present invention relates to technique of controlling a plasma-jet spark plug arranged to produce plasma to ignite a mixture gas, for an internal combustion engine.

BACKGROUND ART

A spark plug for igniting a mixture gas with a spark discharge is used conventionally for an engine or an internal combustion engine for a motor vehicle. Recently, there is a demand for higher output and lower fuel consumption of an internal combustion engine. Accordingly, development is in progress for a plasma-jet spark plug capable of providing faster propagation of combustion, and igniting a lean mixture gas for higher ignition limit air fuel ratio (cf. patent document 1, for example).

Patent document 1: JP 2007-287666 A

The plasma-jet spark plug has a structure including a discharge space (cavity) of a small volume formed by an insulator, such as ceramic insulator, surrounding a spark discharge gap between a center electrode and a ground electrode. In one example of the ignition method of the plasma-jet spark plug, at the time of ignition of a mixture gas, a spark discharge is performed first by applying a high voltage between the center and ground electrodes. Due to the resulting dielectric breakdown, a current with a relatively low voltage can flow in the gap between the center and ground electrodes. Accordingly, a plasma is formed in the cavity by changing the discharge state by the supply of electric power between the center and ground electrodes. By ejecting the thus-formed plasma through a communication hole (so-called orifice), the plasma-jet spark plug performs an ignition to a mixture gas.

However, since the plasma-jet spark plug requires the supply of energy in a large quantity in order to produce plasma, the plasma-jet spark plug is inferior in the durability as compared to the conventional spark plug. Moreover, since the plasma is ejected from the cavity in a small amount of time, the certainty of ignition is low in some cases.

SUMMARY OF INVENTION

In consideration of the above-mentioned problems, it is an object of the present invention to provide control technique for improving the durability and ignitability of a plasma-jet spark plug.

A first aspect of the present invention provides a control system for controlling ignition of a plasma-jet spark plug provided in an internal combustion engine. The control system comprises: a sensing section configured to sense an operating condition or operating conditions of the internal combustion engine; a determining section configured to determine an ignition mode of the plasma-jet spark plug in accordance with the sensed operating condition; and an igniting section configured to perform, in accordance with the determined ignition mode, an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap which is broken down to the dielectric breakdown.

The control system according to the first aspect can determine the ignition mode in accordance with the operating condition of the internal combustion engine provided with the plasma-jet spark plug. Therefore, this control system can perform a control in a manner enabling improvement of the durability and ignitability of the plasma-jet spark plug as compared to a system performing ignition every time in the same mode.

A second aspect of the present invention provides the control system of the first aspect, wherein the determining section determines, as the ignition mode, an ignition timing of the plasma-jet spark plug and a number of times of the ignition per combustion stroke, and the igniting section performs the ignition control according to the determined timing, and the determined number of times of the ignition for one combustion stroke.

The control system according to the second aspect can adjust the ignition timing and the number of times of ignition per combustion stroke in accordance with the operating condition of the internal combustion engine provided with the plasma-jet spark plug. Thus, the control system can performs a plurality of ignition firings at the ignition timing adequate for the operating condition of the internal combustion engine. Therefore, the control system can increase the chance of ignition, and thereby improve the ignition performance of the plasma-jet spark plug.

A third aspect of the present invention provides the control system of the first or second aspect, wherein the determining section determines a power quantity of the second electric power in accordance with the sensed operating condition.

The control system according to the third aspect can adjust the quantity of the electric power for generating plasma in accordance with the operating condition of the internal combustion engine. Therefore, there is no need for applying electric power to the plasma-jet spark plug, beyond necessity, and the control system can improve the durability of the plasma-jet spark plug.

A fourth aspect provides the control system of the third aspect, wherein the determining section determines the above-mentioned power quantity by adjusting the magnitude of a current supplied to the spark discharge gap broken down to the dielectric breakdown, in accordance with the sensed operating condition.

The control system of the fourth aspect can supply, to the plasma-jet spark plug, the electric power in the quantity fitting to the operating condition of the internal combustion engine by adjusting the magnitude of the current as distinguished from the amount of time of current supply.

A fifth aspect of the present invention provides the control system of the third aspect, wherein the determining section determines the power quantity by adjusting a time, or an amount of time, of supply of a current to the spark discharge gap broken down to the dielectric breakdown, in accordance with the sensed operating condition.

The control system of the fifth aspect can supply, to the plasma-jet spark plug, the electric power in the quantity fitting to the operating condition of the internal combustion engine by adjusting the amount of time of the current supply as distinguished from the magnitude of the current.

A sixth aspect of the present invention provides the control system of one of the first through fifth aspects, wherein the igniting section includes a first power supplying section connected with the plasma-jet spark plug and configured to supply the first electric power, and a second power supplying section connected with the plasma-jet spark plug and configured to supply the second electric power, and the igniting section performs the ignition control in the determined ignition mode by varying the quantity of the second electric power supplied from the second power supplying section.

The control system of the sixth aspect is arranged to directly vary the quantity of the second electric power supplied from the second power supplying section to produce plasma. Therefore, the control system can adjust the power quantity accurately in accordance with the operating condition of the internal combustion engine, and supply the accurately adjusted electric power to the plasma-jet spark plug.

A seventh aspect of the present invention provides the control system of the sixth aspect, wherein the second power supplying section of the igniting section includes a power source section connected with the plasma-jet spark plug and configured to supply the second electric power to the plasma-jet spark plug, and a switch arranged to change the conducting or connecting state between the power source section and the plasma-jet spark plug, and the igniting section performs the ignition control in the determined ignition mode by controlling a switchover of the switch.

The control system of the seventh aspect can adjust the ignition mode such as the ignition timing and ignition frequency or number of times of ignition with a relatively simple circuit in which the switch is provided between the power source section and the plasma-jet spark plug.

An eighth aspect of the present invention provides the control system of the seventh aspect, wherein the second power supplying section of the igniting section includes a plurality of sets each including the power source section connected with the plasma-jet spark plug and the switch in a manner of parallel arrangement, and the igniting section performs the ignition control in the determined ignition mode by controlling the switchovers of the switches.

The control system of the eighth aspect can broaden the range of the adjustment of the quantity of power applied to the plasma-jet spark plug by using the plural power source sections.

A ninth aspect of the present invention provides the control system of the sixth aspect, wherein the second power supplying section of the igniting section includes a power source section connected with the plasma-jet spark plug and configured to supply the second electric power to the plasma-jet spark plug, and a switch to change the conducting or connecting state between a connecting portion between the power source section and the plasma-jet spark plug, and a ground or earth, and the igniting section performs the ignition control in the determined ignition mode by controlling a switchover of the switch.

The control system of the ninth aspect can adjust the timing of ending the application of the second electric power easily by controlling the switchover of the switch.

A tenth aspect of the present invention provides the control system of the sixth aspect, wherein the second power supplying section of the igniting section includes a power source section connected, through a transformer, with the plasma-jet spark plug and configured to supply the second electric power to the plasma-jet spark plug, and a switch to change the conducting or connecting state between a primary side of the transformer and a ground or earth, and the igniting section performs the ignition control in the determined ignition mode by controlling a switchover of the switch.

The control system of the tenth aspect can adjust the ignition mode such as the ignition timing and the number of times of ignition with a relatively simple circuit in which the switch is provided at the grounding portion of the transformer connecting the power source section to the plasma-jet spark plug.

An eleventh aspect of the present invention provides the control system of the sixth aspect, wherein the second power supplying section of the igniting section includes a power source section connected with the plasma-jet spark plug and configured to supply the second electric power to the plasma-jet spark plug, and the igniting section performs the ignition control in the determined ignition mode by controlling an output electric power of the power source section.

The control system of the eleventh aspect can adjust the quantity of electric power applied to the plasma-jet spark plug with a relatively simple control of controlling the output power of the power source section.

DETAILED DESCRIPTION

An embodiment or embodiments of the present invention is explained below in the following order, with reference to the drawings.

A. Outline of configuration of control system

B. Construction of plasma-jet spark plug

C. Operation control of internal combustion engine

D. Various make-ups of ignition device

E. Practical examples

A. Outline of Configuration of Control System

Figure 1:
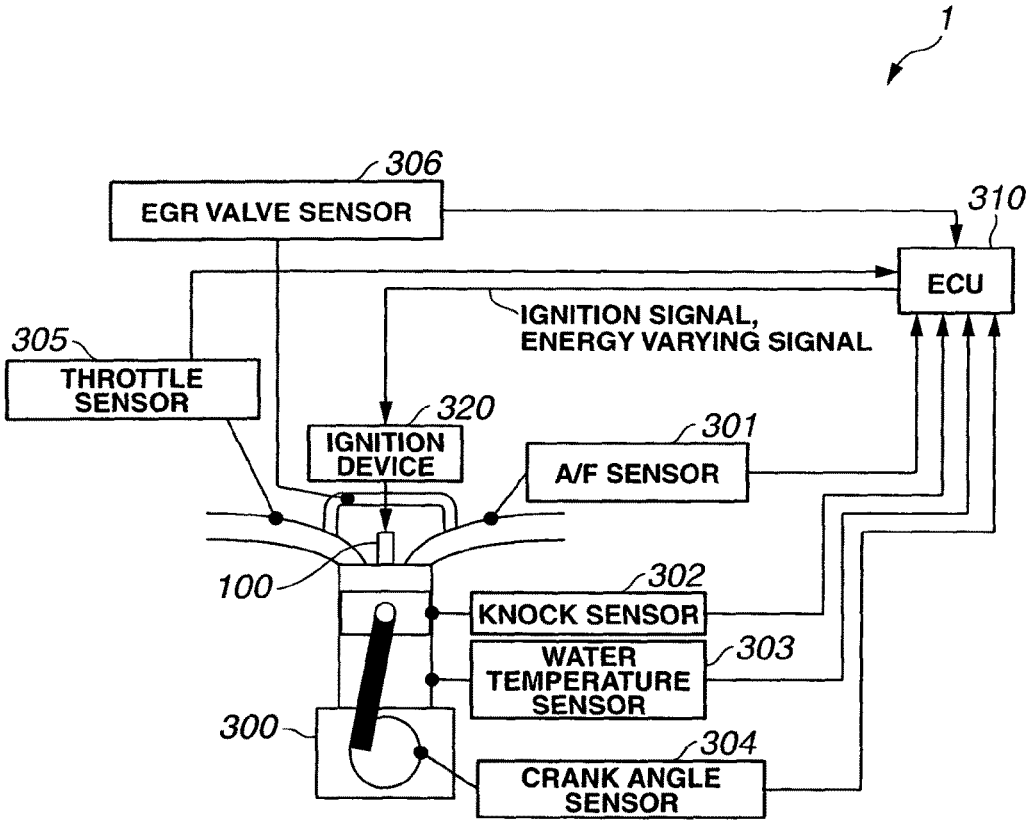
FIG. 1 is a schematic view for illustrating the configuration of a control system for controlling the ignition of a plasma-jet spark plug.

FIG. 1 is a view for illustrating a control system for controlling the ignition of a plasma-jet spark plug in outline. The control system 1 shown in FIG. 1 includes an internal combustion engine 300 provided with a plasma-jet spark plug 100, an ignition device 320 to perform an ignition of the plasma-jet spark plug 100, various sensors to sense one or more operating conditions of internal combustion engine 300, and an ECU (Engine Control Unit) 310 connected with these sensors.

Internal combustion engine 300 is an ordinary four stroke gasoline engine. Internal combustion engine 300 is equipped with an A/F sensor 301 for sensing an air fuel ratio, a knock sensor 302 for sensing the occurrence of knocking, a water temperature sensor 303 for sensing the temperature of a cooling water, a crank angle sensor 304 for sensing the crank angle, a throttle sensor 305 for sensing a throttle opening degree, and an EGR valve sensor 306 for sensing the opening degree of an EGR valve.

These sensors are electrically connected with the ECU 310. From operating condition or conditions of internal combustion engine 300 sensed by these sensors, ECU 310 determines an ignition mode of plasma-jet spark plug 100 such as an ignition timing, an ignition frequency or number of times of ignition, and/or a quantity of energy applied to plasma-jet spark plug 100. Then, in accordance with the determined ignition mode, ECU 310 outputs an ignition signal and an energy varying signal, to the ignition device 320 of plasma-jet spark plug 100. The ignition signal is a trigger signal to initiate the spark discharge of plasma-jet spark plug 100. The energy varying signal is a signal for adjusting or regulating the quantity of energy supplied to plasma-jet spark plug 100 to produce plasma after the spark discharge.

Ignition device 320 performs the ignition control of plasma-jet spark plug 100 in accordance with the ignition signal and the energy varying signal received from ECU 310. Specifically, in response to the ignition signal from ECU 310, the ignition device 320 generates spark discharge by applying a high voltage (first electric power) to plasma-jet spark plug 100, and thereby cause dielectric breakdown in a spark discharge gap. Then, the ignition device 320 applies electric power (second electric power) adjusted in accordance with the energy varying signal received from ECU 310, to the spark discharge gap after the dielectric breakdown. Thus, plasma is ejected from plasma-jet spark plug 100, and the gas mixture is ignited.

In this embodiment, one or more of the sensors corresponds to "sensing section", ECU 310 corresponds to "determining section", and the ignition device 320 corresponds to "igniting section" used in this application.

Figure 2:
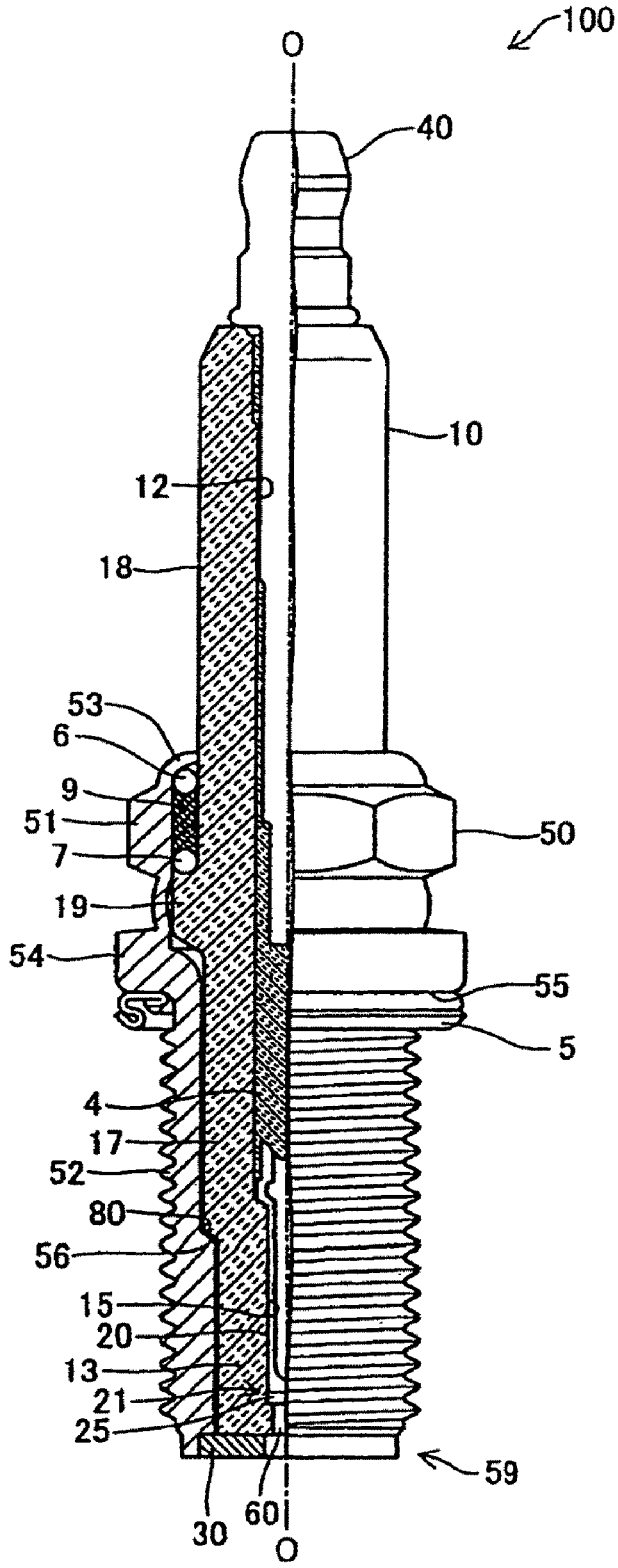
FIG. 2 is a partial sectional view showing the construction of the plasma-jet spark plug 100.
Figure 3:
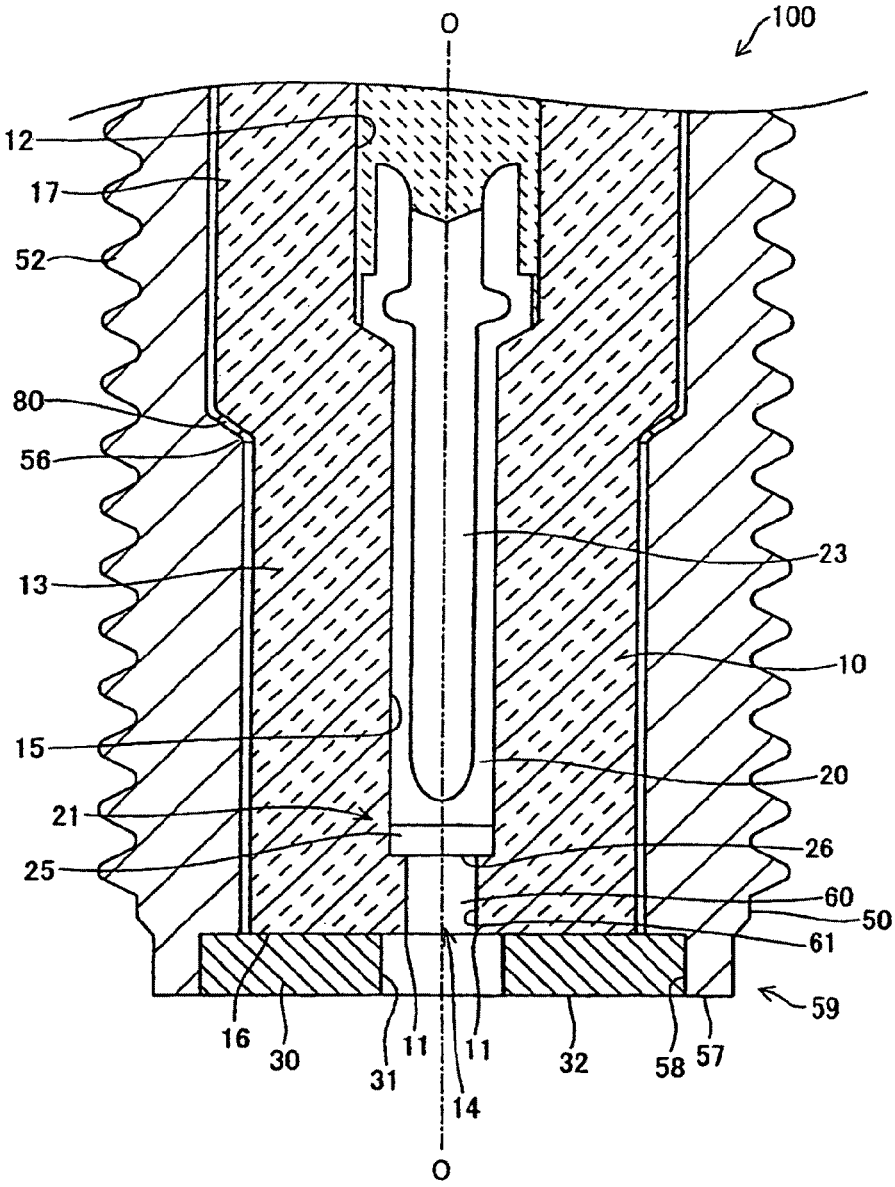
FIG. 3 is an enlarged sectional view showing a forward end portion of the plasma-jet spark plug 100.

B. Construction of Plasma-Jet Spark Plug:

FIG. 2 is a partial sectional view showing the construction of plasma-jet spark plug 100. FIG. 3 is a sectional view showing, in close-up, a forward portion of plasma-jet spark plug 100. In FIG. 2, the direction of an axis O of plasma-jet spark plug 10 is an up and down direction as viewed in FIG. 2. In the following explanation, the lower side and the upper side are referred to as a front side and a rear side, respectively.

As shown in FIG. 2, the plasma-jet spark plug 100 includes an insulator 10, a main metal fitting member 50 supporting the insulator 10, a center electrode 20 supported in the insulator 10 in the direction of axis O, a ground electrode 30 welded to a forward end 59 of main metal fitting member 50, and a terminal metal member 40 provided at a rearward end of the insulator 10.

The insulator 10 is a tubular insulating member formed by calcination of alumina or other material as is known, in the shape of a hollow cylinder having an axial bore 12 extending in the direction of axis O. Insulator 10 includes a flange portion 19 which is formed about the middle of the length in the direction of the axis O, and which has the greatest outside diameter, and a rear trunk portion 18 which is formed on the rear side of flange portion 19. Insulator 10 further includes a front trunk portion 17 which is formed on the front side of flange portion 19 and which is smaller in outside diameter than the rear trunk portion 18, and a leg portion 13 which is formed on the front side of the front trunk portion 17 and which is smaller in outside diameter than the front trunk portion 17. Between the front trunk portion 17 and leg portion 13, there is formed a step.

As shown in FIG. 3, a part of the axial hole 12 located in the leg portion is formed as an electrode receiving portion 15 which is smaller in inside diameter than the part of axial hole 12 extending in the front trunk portion 17, flange portion 19 and rear trunk portion 18. The center electrode 20 is held in this electrode receiving portion 15. Moreover, the axial hole 12 further includes a front small diameter portion 61 which is located on the front side of the electrode receiving portion 15 and which is smaller in inside diameter than the electrode receiving portion 15. The inside circumferential surface of the front small diameter portion 61 meets a front end surface 16 of the insulator 10, and thereby forms an opening 14 of the axial hole 12.

The center electrode 20 is an electrode rod shaped like a circular cylinder and made of Ni alloy such as Inconel (trade name) 600 or 601, or other material. Center electrode 20 includes therein a metal core 23 made of copper or other material superior in thermal conductivity. An electrode tip 25 is joined integrally by welding to a front end 21 of center electrode 20. This electrode tip 25 is shaped like a circular disc and made of an alloy containing, as main component, a noble metal and/or tungsten. In this embodiment, the integral member including the center electrode 20 and the electrode tip 25 integral with center electrode 20 is referred to as "center electrode".

Center electrode 20 includes a rear portion enlarged in outside diameter like an outward flange, and seated, in the axial hole 12, on a stepped portion from which the electrode receiving portion 15 starts, so that center electrode 20 is positioned in electrode receiving portion 15. A circumferential border portion of a front end surface 26 of the front end 21 of center electrode 20 (that is, the front end surface 26 of electrode tip 25 integrally joined to front end 21 of center electrode 20, to be exact) abuts against the step formed between electrode receiving portion 15 and front small diameter portion 61 which are different in diameter. With this arrangement, the inside circumferential surface of font small diameter portion 61 of axial hole 12 and the front end surface 26 of center electrode 20 surround and define a small discharge space of a small volume. This discharge space is referred to as a cavity 60. A spark discharge in the spark discharge gap between ground electrode 30 and center electrode 20 passes through the space and wall surface in this cavity 60. Then, after the occurrence of dielectric or insulation breakdown by the spark discharge, a plasma is formed in this cavity 60 by the application of energy. This plasma is ejected from an open end 11 of the opening 14.

As shown in FIG. 2, the center electrode 20 is electrically connected with a rear metal terminal member 40 through an electrically conductive seal member 4 of a mixture of metal and glass, disposed in the axial hole 12. Center electrode 20 and terminal member 40 are fixed and electrically connected in axial hole 12, by this seal member 4. The terminal member 40 is adapted to be connected through a plug cap (not shown) with a high voltage cable (not shown), through which an electric power is supplied from the ignition device 320 shown in FIG. 1 to the terminal member 40.

Main metal fitting member 50 is a tubular metal member for fixing the plasma-jet spark plug 100 to an engine head of internal combustion engine 300. Main metal fitting member 50 surrounds and holds the insulator 10. Main metal fitting member 50 is made of ferrous material, and includes a tool engagement portion 51 adapted to be fit in a plug wrench not shown, and a threaded portion 52 adapted to be screwed into the engine head provided in the upper part of internal combustion engine 300.

Main metal fitting member 50 includes a staking portion 53 located on the rear side of tool engagement portion 51. Annular ring members 6 and 7 are interposed between the rear trunk portion 18 of insulator 10 and the portion of main metal fitting member 50 including tool engagement portion 51 and staking portion 53. Moreover, power of talc 9 is filled between both ring members 6 and 7. By staking the staking portion 53, the insulator 10 is pushed forward toward the front end in main metal fitting member 50 through the ring members 6 and 7 and talc 9. Consequently, as shown in FIG. 3, the stepped portion between leg portion 13 and front trunk portion 17 of insulator 10 is supported through an annular packing 80 against a stepped abutment portion 56 formed in the inside circumferential surface of main fitting member 50 in the form of a step, so that the main fitting member 50 and insulator 10 is united as a unit. The packing 80 ensures the gas seal between main fitting member 50 and insulator 10, and prevents leakage of combustion gas. Moreover, as shown in FIG. 2, a flange portion 54 is formed between tool engagement portion 51 and threaded portion 52, and a gasket 5 is fit on a seat surface 55 of flange portion 54 in the vicinity of the rear end of threaded portion 52.

The ground electrode 30 is provided at the forward end portion 59 of main fitting member 50. Ground electrode 30 is made of metallic material resistant to wear due to spark. As an example, it is possible to use NI alloy such as Inconel (trade name) 600 or 601. As shown in FIG. 3, ground electrode 30 is a circular disc-shaped member having a through hole 31 at the center. Ground electrode 30 is fit in an engagement portion 58 defined by an inside circumferential surface in the forward end portion 59 of main fitting member 50 in the state in which the thickness direction of ground electrode 30 coincides with the direction of axis O, and the ground electrode 30 abuts on the forward end surface 16 of insulator 10. The periphery of ground electrode 30 is joined, by laser welding, with the engagement portion 58 in a full circle in the state a forward end surface 32 of ground electrode 30 is flush with a forward end surface 57 of main fitting member 50, so that ground electrode 30 is integrally joined with main fitting member 50. The through hole 31 of ground electrode 30 is so sized that the smallest inside diameter of through hole 31 is greater than or equal to the inside diameter of the opening 14 (the open end 11) of insulator 10. The inside of cavity 60 is connected with the outside through the through hole 31.

C. Operation Control of Internal Combustion Engine:

ECU 310 controls the ignition device 320 and thereby performs the ignition of internal combustion engine 300 equipped with the thus-constructed plasma-jet spark plug 100. The following is explanation on the control performed by ECU 310.

Figure 4:
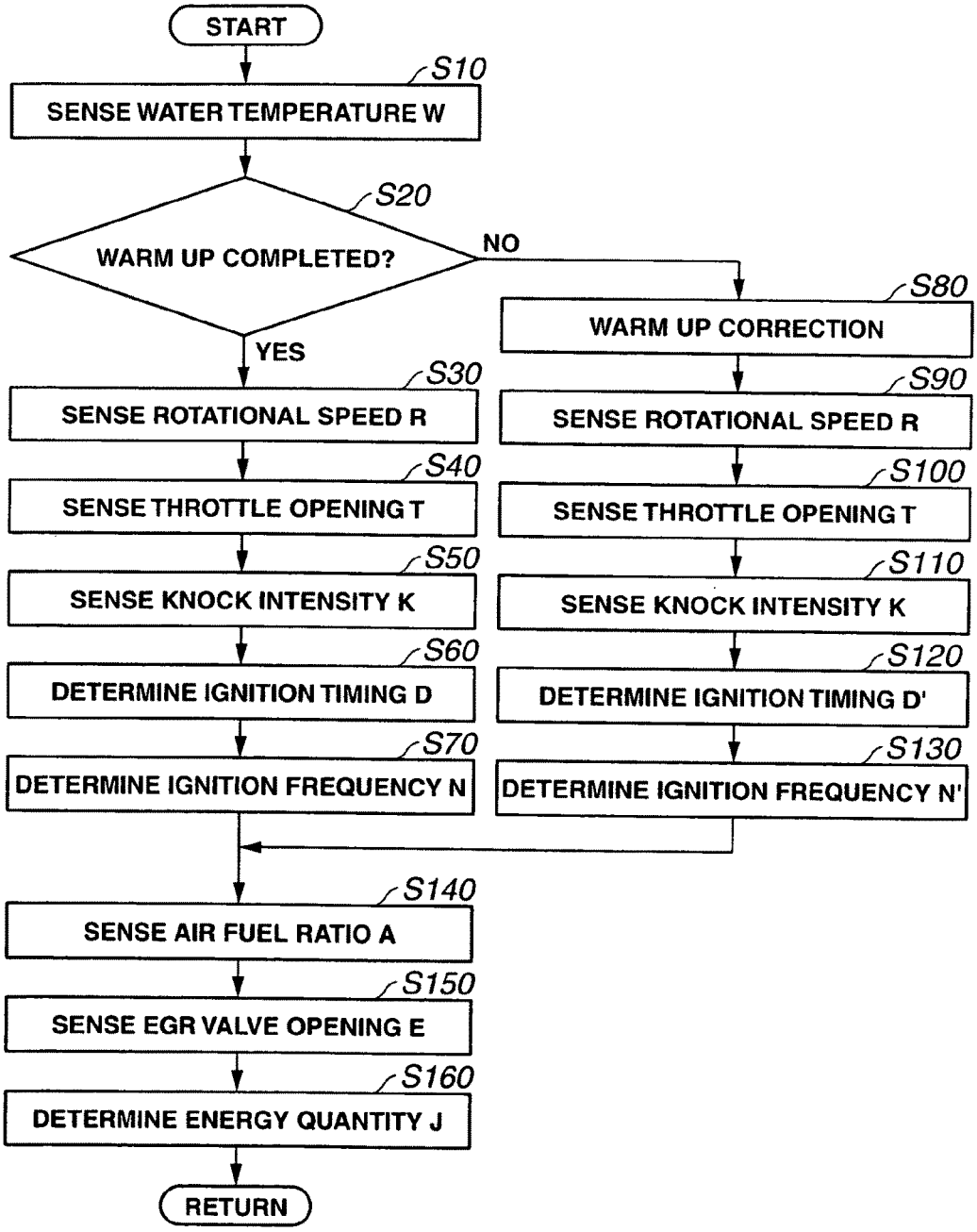
FIG. 4 is a flowchart of a control process of an internal combustion engine 300.

FIG. 4 is a flowchart of a control process of controlling internal combustion engine, performed repeatedly by ECU 310. As shown in FIG. 4, after a start of the control process, ECU 310 first takes in a temperature W of a cooling water or coolant by using the water temperature sensor 303 (at step S10), and examines whether a warm-up of internal combustion engine 300 is completed or not (at step S20). When the judgment is that the temperature W of the cooling water is higher than or equal to a predetermined temperature (70° C., for example), and the warm-up is finished (S20: Yes), then ECU 310 senses a rotational speed R by using crank angle sensor 304 (at step S30), and senses a throttle opening degree T by using throttle sensor 305 (at step S40). Furthermore, ECU 310 senses a knocking intensity K of knocking by using knock sensor 302 (at step S50).

After these operations of sensing one or more operating conditions such as the rotational speed R, throttle opening degree T and knocking intensity K, ECU 310 determines the ignition timing D and the ignition frequency or number of times of ignition N of the plasma-jet spark plug 100 in accordance with these sensed values (at steps S60 and S70). The ignition timing D and the number of time of ignition N are determined, for example, by the following multidimensional functions.

$$D=f(R, T, K)$$

$$N=g(R, T)$$

When the judgment of step S20 is that the warm-up is not yet completed (S20: No), then ECU 310 performs a warm-up correction (at step S80). The warm-up correction is an operation to improve the ignitability at the time of starting the internal combustion engine 300. Namely, ECU 310 senses the rotational speed R by using crank angle sensor 304 (at step S90), and senses the throttle opening degree T by using throttle sensor 305 (at step S100). Furthermore, ECU 310 senses the knocking intensity K by using knock sensor 302 (at step S110). In accordance with these sensed values, ECU 310 determines the ignition timing D' and the number of times of ignition N' of the plasma-jet spark plug 100 (at steps 5120 and S130) for the warm-up period during which the warm-up is not yet completed. During the warm-up period, it is possible to improve the ignitability by advancing the ignition timing as compared to the normal period, and/or increasing the number of times of ignition as compared to the normal period.

After the determination of the ignition timing D and the number of times of ignition N by these operations, ECU 310 senses an air fuel ratio A by using A/F sensor 301 (at step S140), and senses an opening degree E of an EGR valve by using EGR valve sensor 306 (at step S150). Finally, by using the above-mentioned various values, ECU 310 determines a quantity) (peak current and energizing time) of energy to be applied to plasma-jet spark plug 100 after the occurrence of dielectric breakdown in the spark discharge gap (at step S160). For example, the energy quantity J is determined by the following multi-dimensional function.

$$J=h(R, T, A, E, D, N)$$

By repeating the above-mentioned control process, ECU 310 can determine the ignition timing D, the number of times of ignition N and the application energy quantity J for the plasma-jet spark plug 100. In accordance with the thus-determined ignition timing D, number of times of ignition N and energy quantity J, ECU 310 controls the ignition device 320 and causes the ignition of plasma-jet spark plug 100. For determining the ignition timing D, number of times of ignition N and energy quantity J, the above-mentioned functions and/or control map or maps are preliminarily determined on the basis of experimental results obtained in later-mentioned practical examples. By using these functions and/or control map or maps, ECU 310 determines the ignition timing D and number of times of ignition N so as to make the energy quantity J smaller and to improve the certainty of the ignition.

D. Various Make-Ups of Ignition Device

The ignition device 320 shown in FIG. 1 can be implemented by various circuit configurations. The following is explanation on four make-ups of ignition device 320. The following make-ups are not limitative, but it is possible to employ various other make-ups without limitation to the following make-ups.

(D1) First Make-up

Figure 5:
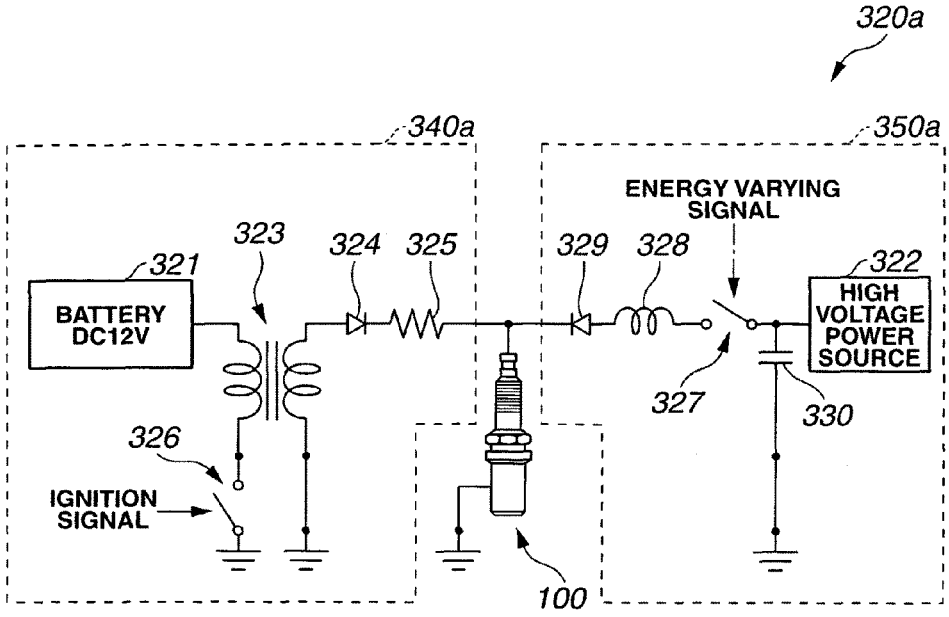
FIG. 5 is a view illustrating a first make-up of an ignition device 320.

FIG. 5 is a view for illustrating the first make-up of ignition device 320. The ignition device in the first make-up is referred to as "ignition device 320*a*" hereinafter. As shown in FIG. 5, the ignition device 320*a* includes a trigger discharge circuit 340*a* for causing dielectric breakdown in plasma-jet spark plug 100 and a plasma discharge circuit 350*a* for applying energy to plasma-jet spark plug 100 after the occurrence of dielectric breakdown.

The trigger discharge circuit 340*a* includes a battery 321 having a voltage of 12V, a step-up transformer 323 to increase the voltage from the voltage of battery 321 to a voltage of several tens of thousands of volts, a diode 324 for preventing reverse flow of current, a resistor 325 and a switch 326. Battery 321, step-up transformer 323, diode 324 and resistor 325 are connected with the center electrode 20 of plasma-jet spark plug 100 in a manner of series circuit. The anode of diode 324 is connected with a secondary side's high voltage portion of step-up transformer 323, and the cathode is connected with one end of resistor 325. Switch 326 is provided at a primary side's grounding portion of step-up transformer 323. This switch 326 may be a semiconductor switch of an N-channel MOSFET, for example. Ignition device 320*a* regulates the ignition timing and the number of times of ignition of plasma-jet spark plug 10 by controlling the open/close state of switch 326 in response to the ignition signal received from ECU 310.

The plasma discharge circuit 350*a* includes a high voltage power source 322 having a voltage of 500-1000V, a switch 327, a coil 328, a diode 329 for preventing a reverse flow of current, and a capacitor 330. The high voltage power source 322, switch 327, coil 328 and diode 329 are connected with the center electrode 20 of plasma-jet spark plug 100 in the manner of series circuit. The anode of diode 329 is connected with one end of coil 328, and the cathode is connected with the center electrode 20 of plasma-jet spark plug 100. Capacitor 330 corresponds to "power source section" of the present application, and is connected between high voltage power source 322 and switch 327 in the state in which one end of capacitor 330 is grounded. Switch 327 may be a semiconductor switch of a P channel MOSFET, for example. Instead of capacitor 330, it is possible to employ an electric power source as long as the internal resistance is low and high energy can be taken out for a short period of time.

Capacitor 330 is charged by high voltage power source 322. The energy charged in capacitor 330 is applied to the center electrode 20 of plasma-jet spark plug 100 when the insulation in the spark discharge gap of plasma-jet spark plug 100 is broken and the switch 327 is turned on by ECU 310. By this application of energy of capacitor 330, the plasma-jet spark plug 100 produces plasma. The ignition device 320*a* adjusts the quantity of energy applied to plasma-jet spark plug 100 by controlling the duty ratio of switching operations of switch 327 in accordance with the energy varying signal received from ECU 310.

The ignition device 320 of the first make-up can adjust the ignition timing and ignition frequency with a relatively simple circuit provided with the switch between the power source section and the plasma-jet spark plug.

(D2) Second Make-Up

Figure 6:
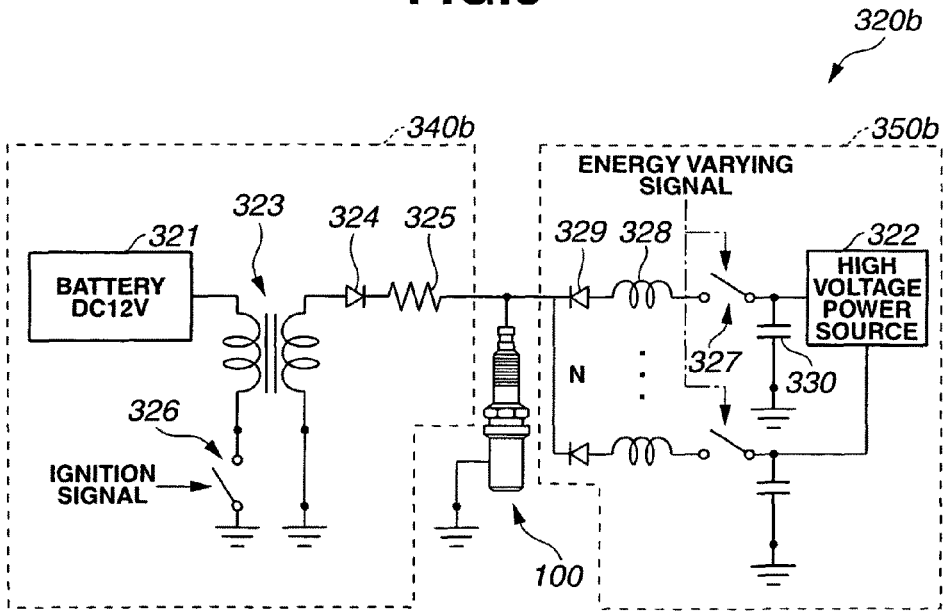
FIG. 6 is a view illustrating a second make-up of an ignition device 320.

FIG. 6 is a view for illustrating the second make-up of ignition device 320. The ignition device in the second make-up is referred to as "ignition device 320*b*" hereinafter. As shown in FIG. 6, the construction of trigger discharge circuit 340*b* of ignition device 320*b* is the same as that of trigger discharge circuit 340*a* shown in FIG. 5. However, a plasma discharge circuit 350*b* includes a number N of sets each of which includes capacitor 330, switch 327, coil 328 and diode 329 and each of which is connected between the high voltage power source 322 and plasma-jet spark plug 100. Therefore, after the occurrence of dielectric breakdown, this plasma discharge circuit 350*b* can supply, to plasma-jet spark plug 100, energy outputted from the capacitors 330 in a parallel manner so that the number of the capacitors 330 is equal to N at the maximum.

The thus-constructed ignition device 320 of the second make-up can vary the quantity of applied energy in a wider range of adjustment wider than the adjustment range of the first make-up, by individually controlling the switches 327 which are equal to N in number, in response to the energy varying signal received from ECU 310.

In the example shown in FIG. 6, one end of each capacitor 330 is connected to a junction point between high voltage power source 322 and the switch 327. However, it is possible to connect one end of each capacitor 330 to a junction point between the switch 327 and coil 328, and to connect the other end to the ground.

(D3) Third Make-up

Figure 7:
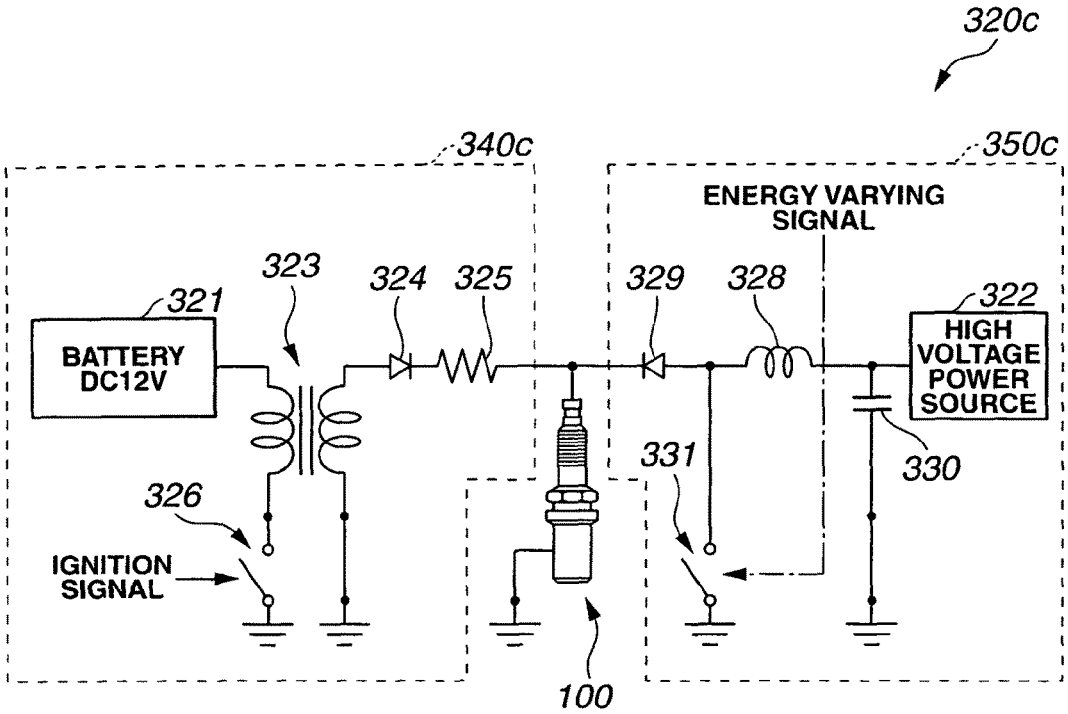
FIG. 7 is a view illustrating a third make-up of an ignition device 320.

FIG. 7 is a view for illustrating the third make-up of ignition device 320. The ignition device in the third make-up is referred to as "ignition device 320*c*" hereinafter. As shown in FIG. 7, the trigger discharge circuit 340*c* of ignition device 320*c* is the same in construction as the trigger discharge circuit 340*a* shown in FIG. 5. However, the plasma discharge circuit 350*c* lacks the switch 327 included in plasma discharge circuit 350*a* shown in FIG. 5, and instead includes a switch 33 lwhich is connected between the coil 328 and diode 329 and which has one end connected to the ground. The ignition device 320c adjusts the quantity of energy applied to plasma-jet spark plug 100 by turning on and off the switch 331 in accordance with the energy varying signal received from ECU 310. Concretely, by turning off the switch, the ignition device 320*c* can apply charges stored in capacitor 330, to plasma-jet spark plug 100. By turning on the switch, on the other hand, the ignition device 320*c* can stop the application of energy to plasma jet spark plug 100 since charges can flow from capacitor 330 to the ground.

By controlling the switchover or switching operation of switch 331, the thus-constructed ignition device 320 of the third make-up can readily adjust the timing of stopping the application of energy to plasma-jet spark plug 100 specifically.

(D4) Fourth Make-up

Figure 8:
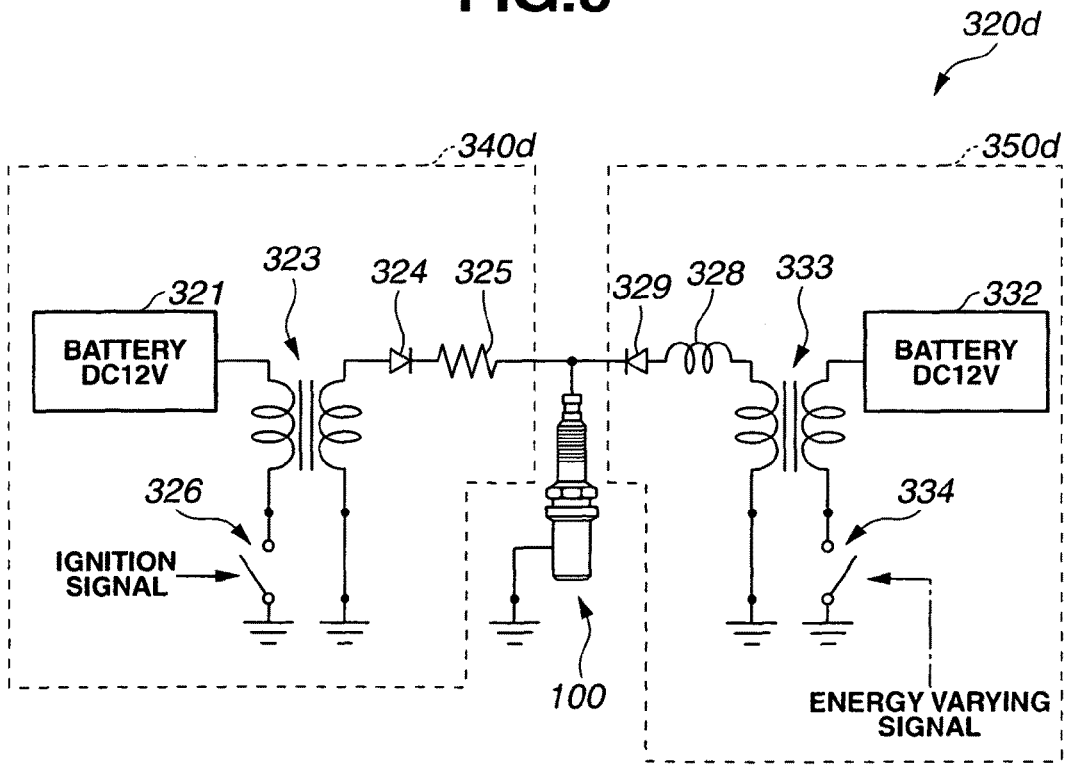
FIG. 8 is a view illustrating a fourth make-up of an ignition device 320.

FIG. 8 is a view for illustrating the fourth make-up of ignition device 320. The ignition device in the fourth make-up is referred to as "ignition device 320*d*" hereinafter. As shown in FIG. 8, the trigger discharge circuit 340*d* of ignition device 320*d* is the same in construction as the trigger discharge circuit 320*a* shown in FIG. 5. However, the plasma discharge circuit 350*d* includes a battery 332 having a voltage of 12V, a high current transformer 333, a coil 328, a diode 329 and a switch 334. The high current transformer 333 is connected between coil 328 and battery 332, and the switch 334 is provided at a primary side's grounding portion of high current transformer 333. The ratio of the number of turns on the primary side and the number of turns on the secondary side of the high current transformer can be 1:1, for example. The ignition device 320*d* can adjust the quantity of energy applied to plasma-jet spark plug 100, by turning on and off the switch 334 provided at the grounding portion of high current transformer 333 in accordance with the energy varying signal received from ECU 310.

The thus-constructed ignition device 320 of the fourth make-up can adjust the ignition timing and the number of times of ignition with a relatively simple circuit in which the switch is provided at the grounding portion of the transformer connecting the power source with the plasma-jet spark plug.

(D5) Fifth Make-up

Figure 9:
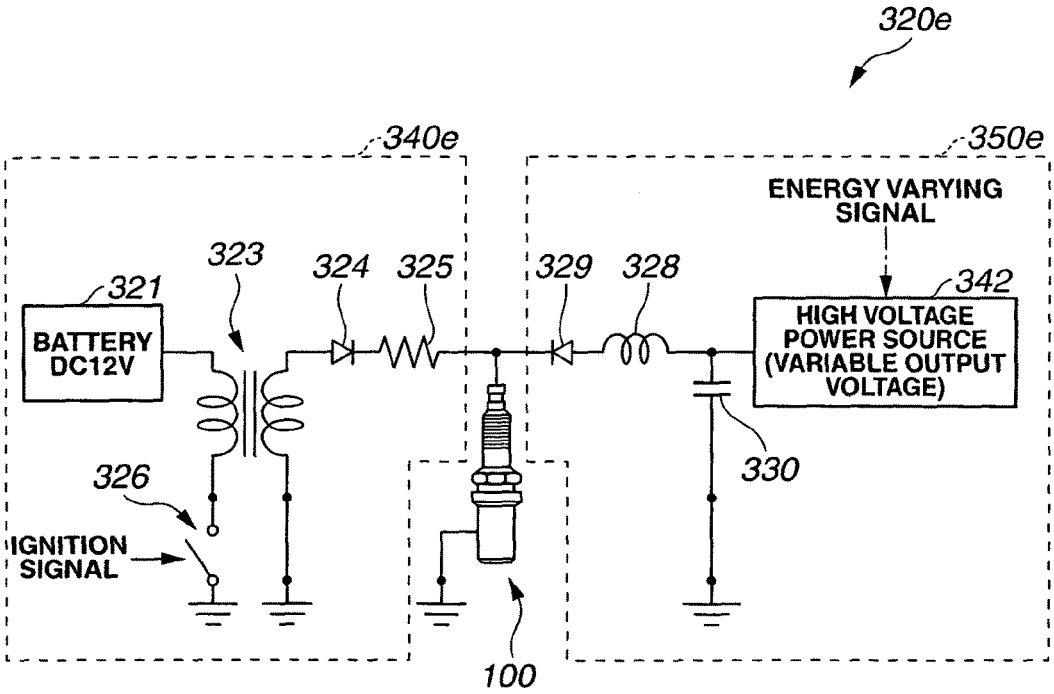
FIG. 9 is a view illustrating a fifth make-up of an ignition device 320.

FIG. 9 is a view for illustrating the fifth make-up of ignition device 320. The ignition device in the fifth make-up is referred to as "ignition device 320*e*" hereinafter. As shown in FIG. 9, the trigger discharge circuit 340*e* of ignition device 320*e* is the same in construction as the trigger discharge circuit 340*a* shown in FIG. 5. However, the plasma discharge circuit 350*e* has the construction in which the switch 327 is omitted from the plasma discharge circuit 350*a* shown in FIG. 5, and the high voltage power source 322 is replaced by a high voltage power source 342 which can be controlled to vary the output voltage. The ignition device 320*e* can adjust the quantity of energy supplied to plasma-jet spark plug 100 by varying the output voltage of high voltage power source 342 in accordance with the energy varying signal received from ECU 310.

The thus-constructed ignition device 320 of the fifth make-up can readily adjust the quantity of electric power applied to plasma-jet spark plug 100 with a relatively simple control of controlling the output voltage of the power source section.

(D6) Sixth Make-up

Figure 10:
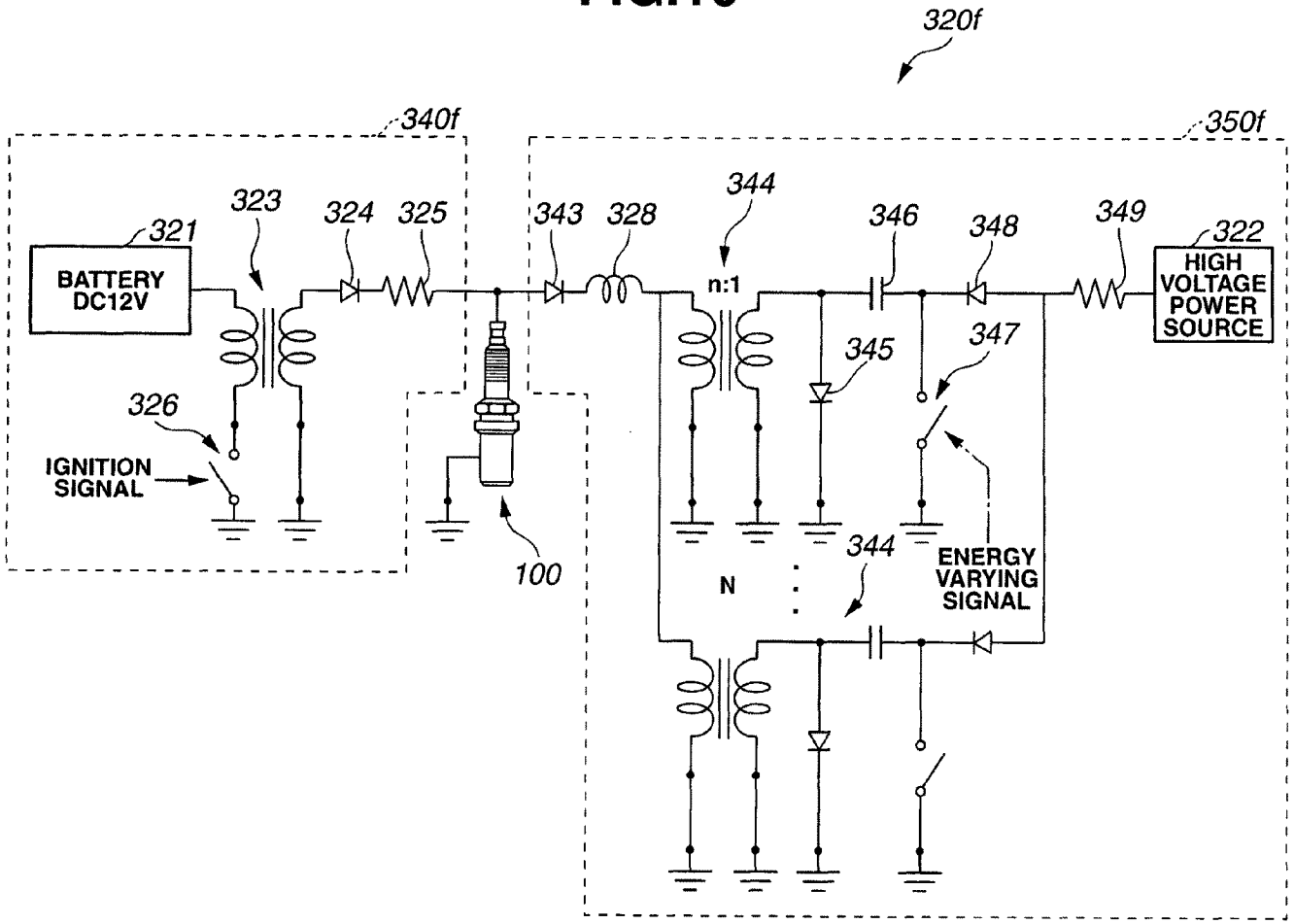
FIG. 10 is a view illustrating a sixth make-up of an ignition device 320.

FIG. 10 is a view for illustrating the sixth make-up of ignition device 320. The ignition device in the sixth make-up is referred to as "ignition device 320*f*" hereinafter. As shown in FIG. 10, the trigger discharge circuit 340*f* of ignition device 3201 is the same in construction as the trigger discharge circuit 320*a* shown in FIG. 5. However, the plasma discharge circuit 350*f* includes a high voltage power source 322, a resistor 349, a diode 348, a switch 347, capacitor 346, a diode 345, a transformer 344, a coil 328 and a diode 343. The anode of diode 343 is connected with the center electrode 20 of plasma-jet spark plug 100, and the cathode is connected with one end of coil 328. The other end of coil 328 is connected with the high voltage portion on the secondary side of transformer 344. The anode of diode 345 is connected with a junction point between the primary side high voltage portion of the transformer and one end of capacitor 346, and the cathode of diode 345 is grounded. The other end of capacitor 346 is grounded through the switch 347. The cathode of diode 348 is connected to a junction point between the other end of capacitor 346 and switch 347, and the anode of diode 348 is connected with one end of resistor 349. The other end of resistor 349 is connected with high voltage power source 322. The plasma discharge circuit 350*f* of ignition device 350*f* of the sixth make-up includes a number N of sets each of which includes the transformer 344, diode 345, capacitor 346, switch 347 and diode 348 and each of which is connected between coil 328 and resistor 349.

The thus-constructed ignition device of the sixth make-up can adjust the quantity of applied energy by respectively controlling the switches 347 which are N in number. Moreover, even in the case of negative discharge caused by the application of a negative high voltage to the center electrode 20 of plasma-jet spark plug 100, the ignition device of the sixth make-up makes it possible to monitor the voltage charged to capacitor 346 easily. With the transformers 344, the ignition device of the sixth make-up makes it possible to use a power source of a lower output voltage as the high voltage power source 322, and hence to use inexpensive parts having lower withstand voltages as parts constituting the circuit.

The trigger discharge circuit 340*a*, 340*b*, 340*c*, 340*d*, 340*e* and/or 340*f* corresponds to "first power supplying section" used in this application, and the plasma discharge circuit 350*a*, 350*b*, 350*c*, 350*d*, 350*e* and/or 350*f* corresponds to "second power supplying section" of this application.

E. Practical Examples:

Various evaluation experiments have been performed, in order to confirm the possibility of improving the certainty of ignition while suppressing the quantity of energy applied to plasma-jet spark plug 100, by controlling the ignition of plasma-jet spark plug 100 with the ignition device assuming various make-ups as mentioned above. The results of the evaluation experiments are explained in the following as practical examples.

(E1) Practical Example 1

Practical example 1 is for showing the reason of the need for reducing the quantity of energy applied to plasma-jet spark plug 100 to improve the durability of plasma-jet spark plug 100.

Figure 11:
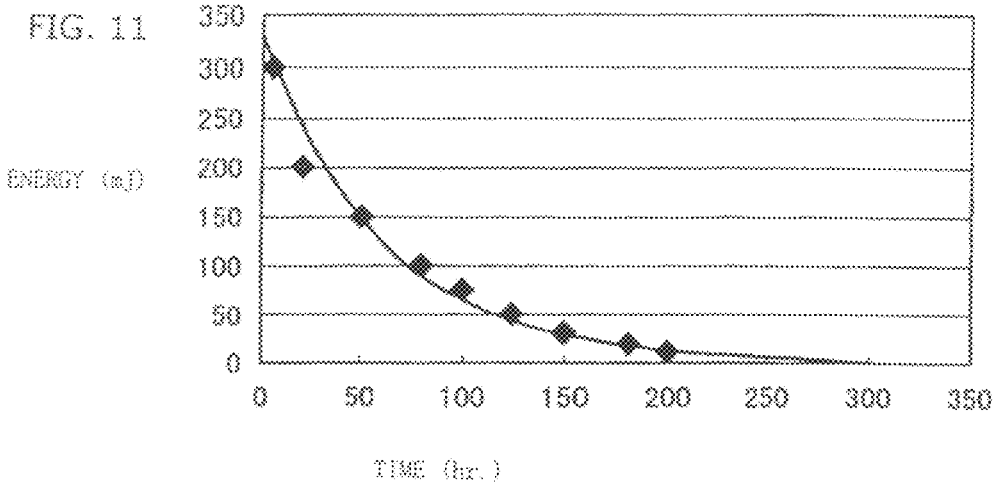
FIG. 11 is a graph showing a relationship between the energy applied to the plasma-jet spark plug and the durability of the plasma-jet spark plug.

FIG. 11 is a graph showing a relationship between the quantity of energy applied to plasma-jet spark plug 100 and the durability of plasma-jet spark plug 100. The vertical axis expresses the quantity of energy applied to plasma-jet spark plug 100 by the plasma discharge circuit 350 for one ignition firing operation. The horizontal axis expresses the time during which the average of the discharge voltage is higher than 30 kV when the ignition is performed 100 times. That is, the horizontal axis expresses the length of time during which the discharge voltage is made higher than a standard because of the spark discharge gap widened by the wear of the electrodes. This experiment was performed by igniting the plasma-jet spark plug 100 repeatedly at a cycle of 100 Hz in the air pressurized to 0.4 MPa. In this environment, the repetition of ignition for 200 hours can provide the experimental result corresponding to travel of an actual vehicle amounting to a distance of about 20000 Km.

As evident from FIG. 11, it is necessary to decrease the quantity of energy applied to plasma-jet spark plug 100 as much as possible in order to improve the durability of plasma-jet spark plug 10 (in other words, to prolong the lifetime of plasma-jet spark plug 100).

(E2) Practical Example 2:

Practical example 2 is for showing how to determine the ignition timing of plasma-jet spark plug 100. In practical example 2, the ignition timing providing the greatest output of internal combustion engine 300 was determined experimentally in internal combustion engine 300 having a displacement of 2.0L under the condition that the air fuel ratio is 16, the EGR rate is 0%, the energy applied to plasma-jet spark plug 100 is 50 mJ, and the number of times of the ignition is one per cycle (for each combustion stroke).

Figure 12:
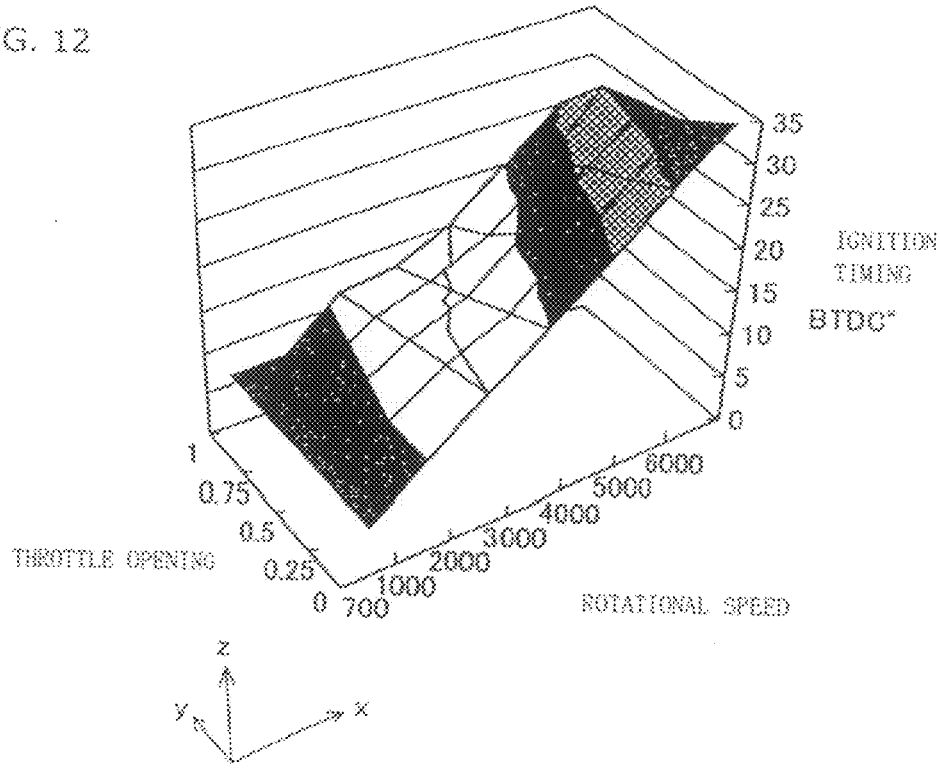
FIG. 12 is a graph showing the ignition timing at which the output of the internal combustion engine 300 is maximized.

FIG. 12 is a graph showing the ignition timing increasing the output of internal combustion engine to the greatest value, obtained by the above-mentioned experiment. The x axis expresses the engine rotational speed, the y axis expresses the throttle opening degree, and the z axis expresses the ignition timing (BTDC°). As evident from this graph, if the rotational speed and throttle opening degree can be sensed, it is possible to determine an angular position of the ignition timing to obtain the greatest output. The graph shown in FIG. 12 is preliminarily stored in the form of a map, and, by using the map, ECU 310 can determine the ignition timing to obtain the greatest output, in accordance with the throttle opening degree sensed by throttle sensor 305 and the rotational speed sensed by crank angle sensor 304.

(E3) Practical Example 3

In practical example 3, at the ignition timing determined by the graph of practical example 2, the ignition frequency or the number of times of ignition (or ignition firinings) per cycle (for each combustion stroke) to ensure the ignitability was determined experimentally. In this experiment, the minimum number of times of ignition to make the probability of misfire lower than or equal to 0.1% was determined in the internal combustion engine 300 having a displacement of 2.0 L under the condition that the energy applied to plasma-jet spark plug 100 is 25 mJ.

Figure 13:
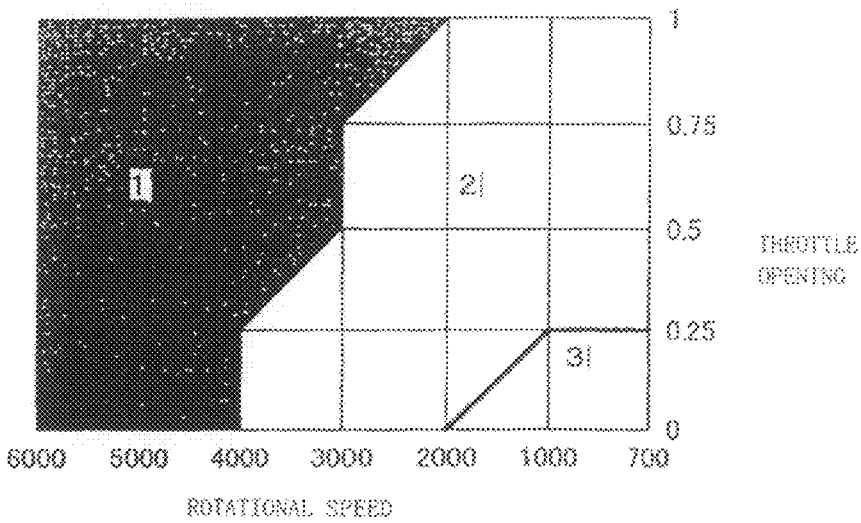
FIG. 13 is a graph showing the minimum number of times of ignition providing the misfire probability lower than or equal to 0.1%.

FIG. 13 is a graph showing the minimum number of times of ignition to make the probability of misfire lower than or equal to 0.1% under the above-mentioned condition. The horizontal axis expresses the rotational speed, and the vertical axis expresses the throttle opening degree. When the throttle opening degree is small and the rotational speed is low, the probability of misfire could be made lower than or equal to 0.1% by setting the number of times of ignition equal to three, as shown in the figure. When the rotational speed is higher than 3000 rpm, the probability of misfire could be made lower than or equal to 0.1% generally by setting the number of times of ignition equal to one.

The graph of FIG. 13 is preliminarily stored in the form of a map, and by using this map, ECU 310 can determine the number of times of ignition effective for high ignition performance, in accordance with the throttle opening degree sensed by throttle sensor 305 and the rotational speed sensed by crank angle sensor 304. Although an ordinary spark plug requires time of about 3 msec for spark discharge, the plasma-jet spark plug 100 takes a time of only about 20μ seconds for one ignition firing including ejection of plasma. Therefore, from the ignition timing determined from FIG. 11, ECU 310 can perform the ignition a plurality of times during one combustion stroke, by performing ignition firings at regular time intervals of 20μ seconds, so that the number of ignition firings becomes equal to the number of times determined from FIG. 13.

(E4) Practical Example 4

In practical example 4, experiment was performed for determining the minimum applied energy providing a misfire probability of 0.1% or less by varying only one of operating conditions of the internal combustion engine 300. In this experiment, the operating conditions of internal combustion engine 300 were basically set as follows: the rotational speed is 700 rpm, the air fuel ratio is 16, the number of times of ignition is one (per cycle), the throttle opening degree is 0.25, the ignition timing is BTDC 5°, and the EGR rate is 10%.

Figure 14:
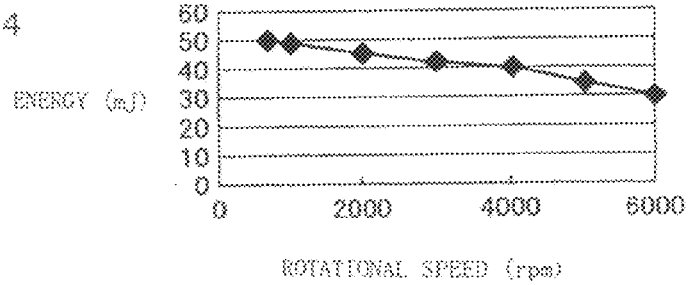
FIG. 14 is a graph showing the results of an experiment for determining the minimum application energy providing the misfire probability lower than or equal to 0.1% by varying the rotational speed of the internal combustion engine 300.

FIG. 14 is a graph showing the results of experiment for determining the minimum applied energy making the misfire probability lower than or equal to 0.1% by varying the rotational speed of internal combustion engine 300. The horizontal axis expresses the rotational speed, and the vertical axis expresses the energy applied to plasma-jet spark plug 100. As shown in the graph, as the rotational speed of internal combustion engine 300 is increased, the energy applied to plasma-jet spark plug 100 can be decreased.

Figure 15:
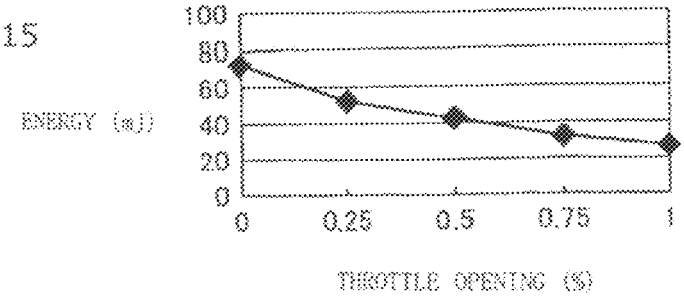
FIG. 15 is a graph showing the results of an experiment for determining the minimum application energy providing the misfire probability lower than or equal to 0.1% by varying the throttle opening degree.

FIG. 15 is a graph showing the results of experiment for determining the minimum applied energy making the misfire probability lower than or equal to 0.1% by varying the throttle opening degree. The horizontal axis expresses the throttle opening degree, and the vertical axis expresses the energy applied to plasma-jet spark plug 100. As shown in the graph, as the throttle opening degree of internal combustion engine 300 is increased, the energy applied to plasma-jet spark plug 100 can be decreased.

Figure 16:
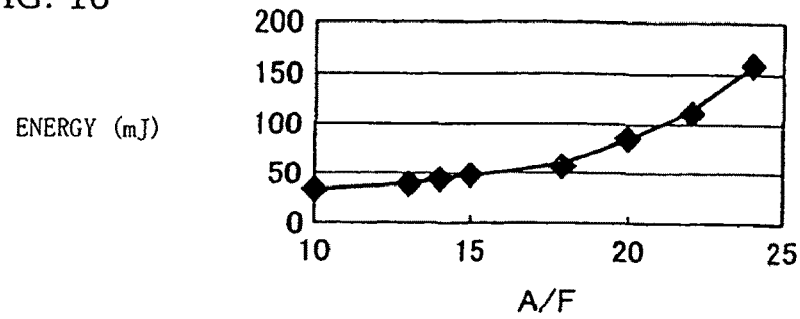
FIG. 16 is a graph showing the results of an experiment for determining the minimum application energy providing the misfire probability lower than or equal to 0.1% by varying the air fuel ratio.

FIG. 16 is a graph showing the results of experiment for determining the minimum applied energy making the misfire probability lower than or equal to 0.1% by varying the air fuel ratio. The horizontal axis expresses the air fuel ratio, and the vertical axis expresses the energy applied to plasma-jet spark plug 100. As shown in the graph, as the fuel ratio of internal combustion engine 300 is lowered, that is as the percentage of the fuel is increased, the energy applied to plasma-jet spark plug 100 can be decreased.

Figure 17:
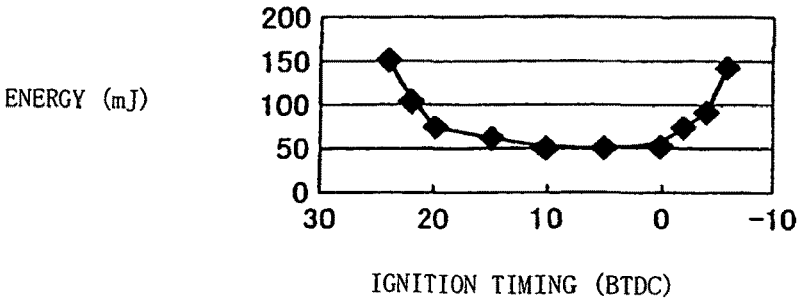
FIG. 17 is a graph showing the results of an experiment for determining the minimum application energy providing the misfire probability lower than or equal to 0.1% by varying the ignition timing.

FIG. 17 is a graph showing the results of experiment for determining the minimum applied energy making the misfire probability lower than or equal to 0.1% by varying the ignition timing. The horizontal axis expresses the ignition timing, and the vertical axis expresses the energy applied to plasma-jet spark plug 100. As shown in the graph, under the above-mentioned condition, the energy applied to plasma-jet spark plug 100 can be decreased in a range of the ignition timing from 0° to 20°.

Figure 18:
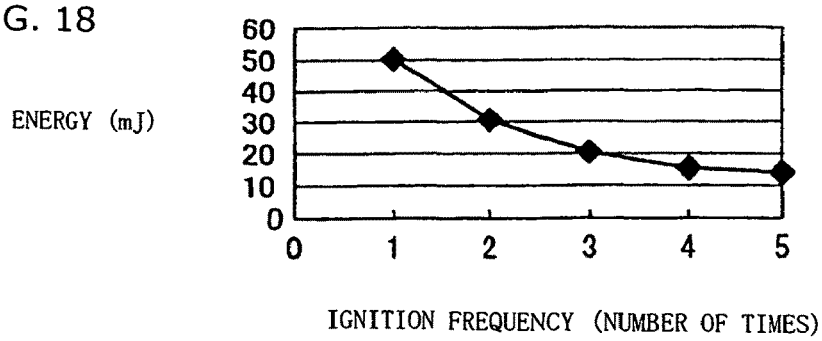
FIG. 18 is a graph showing the results of an experiment for determining the minimum application energy providing the misfire probability lower than or equal to 0.1% by varying the number of times of ignition.

FIG. 18 is a graph showing the results of experiment for determining the minimum applied energy making the misfire probability lower than or equal to 0.1% by varying the number of times of ignition. The horizontal axis expresses the number of times of ignition, and the vertical axis expresses the energy applied to plasma-jet spark plug 100. As shown in the graph, as the number of times of ignition of internal combustion engine 300 is increased, the energy applied to plasma-jet spark plug 100 can be decreased.

Figure 19:
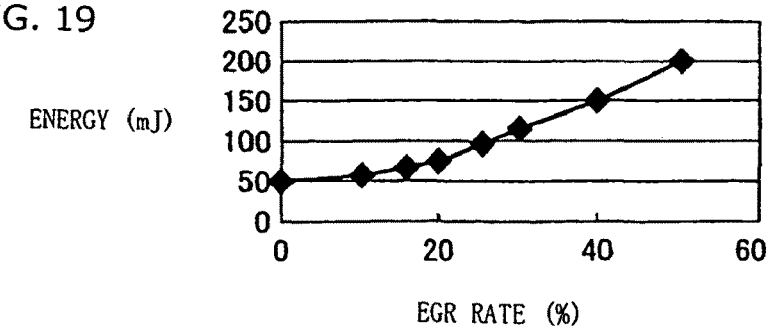
FIG. 19 is a graph showing the results of an experiment for determining the minimum application energy providing the misfire probability lower than or equal to 0.1% by varying the EGR rate.

FIG. 19 is a graph showing the results of experiment for determining the minimum applied energy making the misfire probability lower than or equal to 0.1% by varying the EGR rate. The horizontal axis expresses the EGR rate, and the vertical axis expresses the energy applied to plasma-jet spark plug 100. As shown in the graph, as the quantity of exhaust gas recirculation is decreased by decreasing the EGR rate, the energy applied to plasma-jet spark plug 100 can be decreased.

As evident from the practical example 4, it is possible to decrease the energy applied to plasma-jet spark plug 100 by performing at least a part of control operations of increasing the rotational speed of internal combustion engine 300, increasing the throttle opening degree, lowering the air fuel ratio, adjusting the ignition timing in the range of 0°~20°, increasing the number of times of ignition, and decreasing the EGR rate. By performing such control, it is possible to improve the durability of plasma-jet spark plug 100.

(E5) Practical Example 5:

In practical example 5, experiment was performed for determining the minimum applied energy making the misfire probability lower than or equal to 0.1% by varying the greatest value of current supplied to plasma-jet spark plug 100 and the time of supply of current or energizing time, respectively. In this experiment, the operating conditions of internal combustion engine 300 were set as follows: the rotational speed is 700 rpm, the air fuel ratio is 16, the number of times of ignition is one (per cycle), the throttle opening degree is 0.25, the ignition timing is BTDC 5°, and the EGR rate is 0%.

Figure 20:
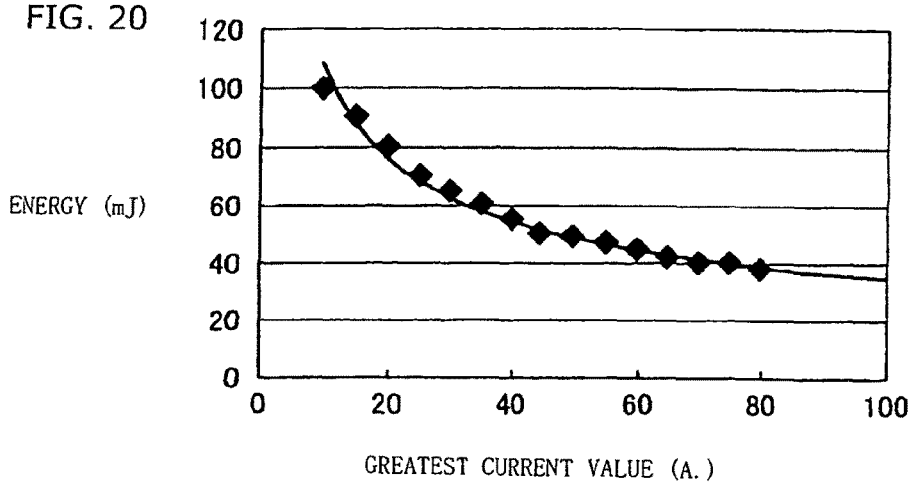
FIG. 20 is a graph showing the results of an experiment for determining the minimum application energy providing the misfire probability lower than or equal to 0.1% by varying the greatest current value.

FIG. 20 is a graph showing the results of experiment for determining the minimum applied energy making the misfire probability lower than or equal to 0.1% by varying the greatest current value. The horizontal axis expresses the greatest value of the supplied current, and the vertical axis expresses the minimum applied energy making the misfire probability lower than or equal to 0.1%. As shown in the graph, as the greatest value of current supplied to plasma-jet spark plug 100 is increased, the required energy is decreased gradually.

Figure 21:
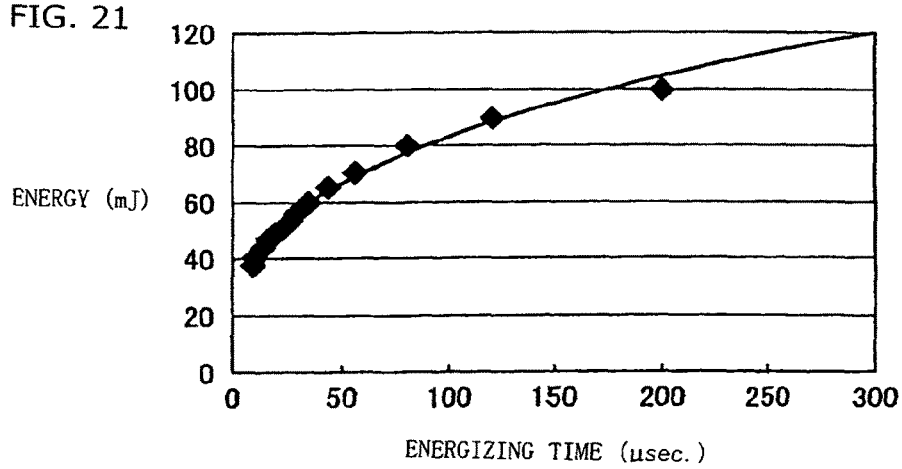
FIG. 21 is a graph showing the results of an experiment for determining the minimum application energy providing the misfire probability lower than or equal to 0.1% by varying the time of current supply.

FIG. 21 is a graph showing the results of experiment for determining the minimum applied energy for making the misfire probability lower than or equal to 0.1% by varying the time of supplying the current. The horizontal axis expresses the time during which the current is supplied, and the vertical axis expresses the minimum applied energy making the misfire probability lower than or equal to 0.1%. As shown in the graph, as the time of supply of the current to plasma-jet spark plug 100 is increased, the required energy is increased gradually.

As evident from the results of practical example 5, it is possible to decrease the quantity of energy applied to plasma-jet spark plug 100 by increasing the greatest current value or prolonging the time of the current supply in the operation of supplying the current to plasma-jet spark plug 100 by the plasma discharge circuit 350. Accordingly, by performing such control, it is possible to improve the durability of plasma-jet spark plug 100. Since the time during which the energization is feasible is variable in dependence on the ignition timing, the number of times of ignition and the rotational speed, it is preferable to reduce the quantity of applied energy by adjusting the greatest current value rather than the energizing time of the current supply.

(E6) Practical Example 6

In practical example 6, an experiment was performed for determining the minimum energy making the misfire probability lower than or equal to 0.1% by varying the time to start the application of energy to plasma-jet spark plug 100 (hereinafter referred to as "application start time"), and the time to stop or terminate the application of energy (hereinafter referred to as "application stop time". In this experiment, the operating conditions of internal combustion engine 300 were set as follows: the rotational speed is 700 rpm, the air fuel ratio is 16, the number of times of ignition is one (per cycle), the throttle opening degree is 0.25, the ignition timing is BTDC 5°, and the EGR rate is 0%.

Figure 22:
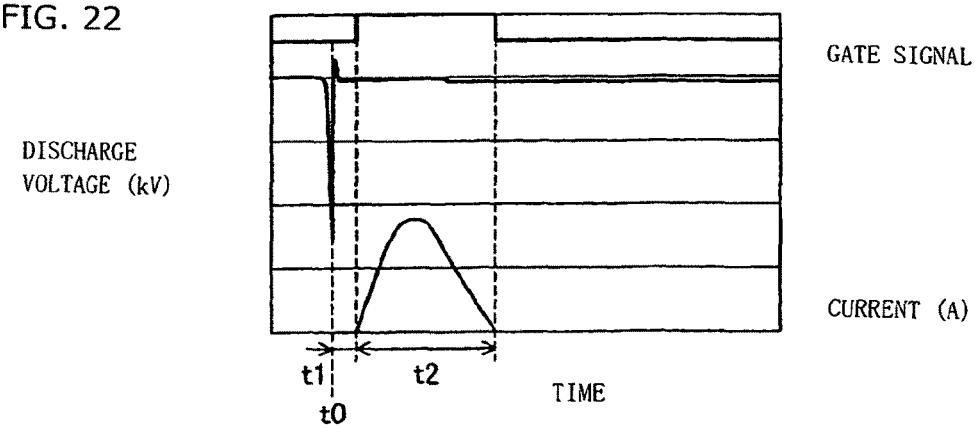
FIG. 22 is a view for illustrating the concepts of an application start time and an application stop time.
Figure 23:
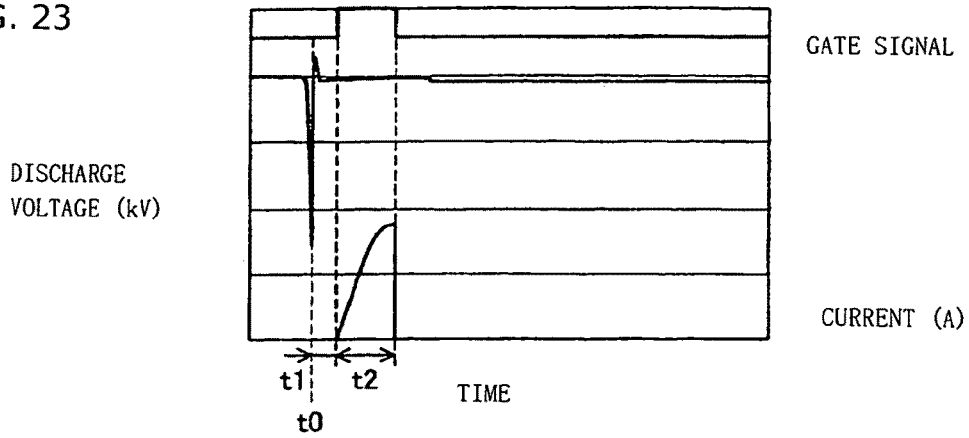
FIG. 23 is a view for illustrating the concepts of the application start time and application stop time.

FIGS. 22 and 23 are views for illustrating the concepts of the application start time and the application stop time. In FIGS. 22 and 23, the timing denoted by "t0" is a timing at which the spark discharge gap of plasma-jet spark plug 100 is brought to the state of dielectric breakdown by the discharge of trigger discharge circuit 340. A time "t1" is a time or time interval (the application start time) for starting the application of energy (current) to plasma-jet spark plug 100 from plasma discharge circuit 350, after the timing t0. Moreover, a time "t2" is a time or time interval (the application stop time) from the start of the application of energy to an end of the application of energy.

This experiment was performed by using a circuit combining the plasma discharge circuit 350 shown in FIG. 5 and the plasma discharge circuit 350 shown in FIG. 7, in order to facilitate the adjustment of the application start time t1 and application stop time t2. The application start time can be adjusted easily by turning the switch 327 of the plasma discharge circuit 350 shown in FIG. 5, from off to on. The application of energy can be stopped immediately as shown in FIG. 23, by turning the switch 331 of the plasma discharge circuit 350 shown in FIG. 7, from off to on.

Figure 24:
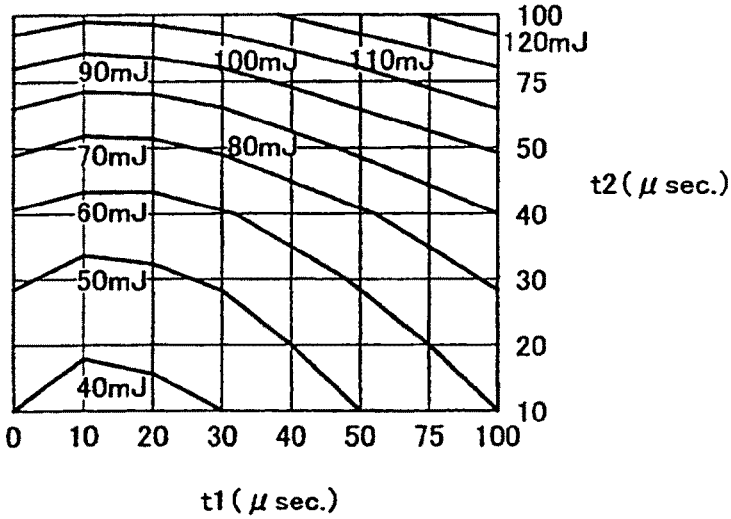
FIG. 24 is a graph showing the results of an experiment for determining the minimum application energy providing the misfire probability lower than or equal to 0.1% by varying the application start time t1 and application stop time t2.

FIG. 24 is a graph showing the results of experiment for determining the minimum applied energy for making the misfire probability lower than or equal to 0.1% by varying the application start time t1 and the application stop time t2. The horizontal axis expresses the application start time t1, and the vertical axis expresses the application stop time t2. As shown in the graph, in this experiment, as the application start time t1 is advanced and moreover as the application stop time t2 is advanced, the required energy can be reduced. This result of the experiment complies with the experimental result shown in FIG. 21. That is, from a comprehensive viewpoint of the experimental results of this practical example and the practical example 5, it is understood that the energy applied from the plasma discharge circuit 350 to plasma-jet spark plug 100 can be decreased by supplying a higher current for a shorter period of time.

Although the invention has been described above by reference to various embodiments, make-ups and practical examples of the invention, the invention is not limited to the embodiments, make-ups and examples described above, and various other configurations are possible within the purview of the present invention. For example, although the plasma-jet spark plug 100 is used as the ignition device for a gasoline engine in the above-mentioned embodiment, it is possible to use as a start assisting device (glow plug) for a diesel engine etc. Moreover, although, in the flowchart of the control process shown in FIG. 4, the ignition timing, the number of times of ignition, and the energy quantity are all determined in accordance with sensed values, it is possible to determine at least any one of these parameters in accordance with sensed value or values, and setting the other parameter or parameters as fixed value or fixed values.

The invention claimed is:

1. A control system for controlling ignition of a plasma jet spark plug provided in an internal combustion engine, the control system comprising:

a sensing section to sense an operating condition of the internal combustion engine;

a determining section to determine an ignition mode of the plasma-jet spark plug in accordance with the sensed operating condition; and an igniting section to perform an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the igniting section includes a first power supplying section connected with the plasma-jet spark plug and configured to supply the first electric power, and a second power supplying section connected with the plasma-jet spark plug and configured to supply the second electric power in a power quantity, and the igniting section performs the ignition control in the determined ignition mode by varying the second electric power supplied from the second power supplying section; and wherein the second power supplying section of the igniting section includes a power source section connected with the plasma-jet spark plug and configured to supply the second electric power to the plasma-jet spark plug, and a switch to change a conducting state between the power source section and the plasma-jet spark plug, and the igniting section performs the ignition control in the determined ignition mode by controlling a switchover of the switch.

2. The control system as recited in claim 1, wherein the determining section determines, as the ignition mode, an ignition timing of the plasma jet spark plug and a number of times of the ignition for one combustion stroke, and the igniting section performs the ignition control at the determined timing, with the determined number of times of the ignition for one combustion stroke.

3. The control system as recited in claim 2, wherein the determining section determines a power quantity of the second electric power in accordance with the sensed operating condition.

4. The control system as recited in claim 3, wherein the determining section determines the power quantity by adjusting a value of a current supplied to the spark discharge gap broken down to the dielectric breakdown, in accordance with the sensed operating condition.

5. The control system as recited in claim 3, wherein the determining section determines the power quantity by adjusting a time of supply of a current to the spark discharge gap broken down to the dielectric breakdown, in accordance with the sensed operating condition.

6. The control system as recited in claim 1, wherein the second power supplying section of the igniting section includes a plurality of sets each including the power source section connected with the plasma-jet spark plug and the switch in a manner of parallel arrangement, and the igniting section performs the ignition control in the determined ignition mode by controlling the switchovers of the switches.

7. The control system as recited in claim 1, wherein the power source section includes a capacitor including a first end connected with a junction point between the switch and a high voltage source and a second end grounded.

8. A control system for controlling ignition of a plasma-jet spark plug provided in an internal combustion engine, the control system comprising:

a sensing section to sense an operating condition of the internal combustion engine, a determining section to determine an ignition mode of the plasma-jet spark plug in accordance with the sensed operating condition; and an igniting section to perform an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the igniting section includes a first power supplying section connected with the plasma-jet spark plug and configured to supply the first electric power, and a second power supplying section connected with the plasma-jet spark plug and configured to supply the second electric power in a power quantity, and the igniting section performs the ignition control in the determined ignition mode by varying the second electric power supplied from the second power supplying section; and wherein the second power supplying section of the igniting section includes a power source section connected with the plasma-jet spark plug and configured to supply the second electric power to the plasma-jet spark plug, and a switch to change a conducting state between a ground and a connecting portion between the power source section and the plasma-jet spark plug, and the igniting section performs the ignition control in the determined ignition mode by controlling a switchover of the switch.

9. A control system for controlling ignition of a plasma-jet spark plug provided in an internal combustion engine, the control system comprising:

a sensing section to sense an operating condition of the internal combustion engine;

a determining section to determine an ignition mode of the plasma-jet spark plug in accordance with the sensed operating condition; and an igniting section to perform an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the igniting section includes a first power supplying section connected with the plasma-jet spark plug and configured to supply the first electric power, and a second power supplying section connected with the plasma-jet spark plug and configured to supply the second electric power in a power quantity, and the igniting section performs the ignition control in the determined ignition mode by varying the second electric power supplied from the second power supplying section; and wherein the second power supplying section of the igniting section includes a power source section connected, through a transformer, with the plasma-jet spark plug and configured to supply the second electric power to the plasma-jet spark plug, and a switch to change a conducting state between a primary side of the transformer and a ground, and the igniting section performs the ignition control in the determined ignition mode by controlling a switchover of the switch.

10. A control method for controlling ignition of a plasma-jet spark plug provided in an internal combustion engine, the control method comprising:

sensing an operating condition of the internal combustion engine;

determining an ignition mode of the plasma-jet spark plug in accordance with the sensed operating condition; and performing an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the ignition control is performed by performing a first power supplying operation of supplying the first electric power to the plasma jet spark plug, and a second power supplying operation of supplying the second electric power to the plasma-jet spark plug, and the ignition control is performed in the determined ignition mode by varying the second electric power supplied in the second power supplying operation;

wherein the second electric power is supplied to the plasma-jet spark plug from a power source section connected with the plasma-jet spark plug, and the ignition control is performed by controlling a switchover of a switch to change a conducting state between the power source section and the plasma-jet spark plug.

11. A control method for controlling ignition of a plasma-jet spark plug provided in an internal combustion engine, the control method comprising:

sensing an operating condition of the internal combustion engine;

determining an ignition mode of the plasma-jet spark plug in accordance with the sensed operating condition; and performing an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the ignition control is performed by performing a first power supplying operation of supplying the first electric power to the plasma jet spark plug, and a second power supplying operation of supplying the second electric power to the plasma-jet spark plug, and the ignition control is performed in the determined ignition mode by varying the second electric power supplied in the second power supplying operation;

wherein the second electric power is supplied to the plasma-jet spark plug from a power source section connected with the plasma-jet spark plug, and the ignition control is performed by controlling a switchover of a switch to change a conducting state between a ground and a connecting portion between the power source section and the plasma-jet spark plug.

12. A control method for controlling ignition of a plasma-jet spark plug provided in an internal combustion engine, the control method comprising:

sensing an operating condition of the internal combustion engine;

determining an ignition mode of the plasma-jet spark plug in accordance with the sensed operating condition; and performing an ignition control of causing a dielectric breakdown across a spark discharge gap of the plasma-jet spark plug by applying a first electric power to the plasma-jet spark plug, and thereafter producing a plasma in the vicinity of the spark discharge gap by applying a second electric power to the spark discharge gap where the dielectric breakdown is caused, in accordance with the determined ignition mode;

wherein the ignition control is performed by performing a first power supplying operation of supplying the first electric power to the plasma jet spark plug, and a second power supplying operation of supplying the second electric power to the plasma-jet spark plug, and the ignition control is performed in the determined ignition mode by varying the second electric power supplied in the second power supplying operation;

wherein the second electric power is supplied to the plasma jet spark plug from a power source section connected, through a transformer, with the plasma-jet spark plug, and the ignition control is performed by controlling a switchover of a switch to change a conducting state between a primary side of the transformer and a ground.

* * * * *